US005934947A

United States Patent [19]

Liang

[11] Patent Number: 5,934,947

[45] Date of Patent: Aug. 10, 1999

[54] BATTERY CONNECTOR

[76] Inventor: Shih-Tsung Liang, No. 10, Lane 31, Ta-Feng St., Lu-Chu Hsiang, Taoyuan County, Taiwan

[21] Appl. No.: 09/062,675

[22] Filed: Apr. 21, 1998

[51] Int. Cl.[6] ..... H01R 4/42

[52] U.S. Cl. ..... 439/762

[58] Field of Search ..... 439/762, 763, 439/765

[56] References Cited

U.S. PATENT DOCUMENTS 4,354,726 10/1982 Kato et al. ..... 439/763
5,316,505 5/1994 Kipp ..... 439/762

FOREIGN PATENT DOCUMENTS 2420053 11/1974 Germany ..... 439/762

*Primary Examiner*—Steven L. Stephan
*Assistant Examiner*—J. F. Duverne
*Attorney, Agent, or Firm*—Rosenberg, Klein & Bilker

[57] ABSTRACT

A battery connector includes a conductive base having two receiving portions separated by a longitudinal split for receiving electrical cables in holes thereon and a smoothly arched mounting portion connected between the receiving portions at one end, and a screw bolt inserted through a transverse through hole on one receiving portion and threaded into a transverse screw hole on the other receiving portion to fasten up the receiving portion, so as to secure the smoothly arched mounting portion to a terminal of a battery.

2 Claims, 3 Drawing Sheets

BATTERY CONNECTOR

BACKGROUND OF THE INVENTION

The present invention relates to a battery connector used for securing electrical cables to a terminal of a battery.

FIGS. 5 and 6 show a battery connector according to the prior art. This structure of battery connector comprises a base 3 having a through hole in which a screw is mounted and screwed up with a wing nut to secure an electrical cable to the base 3, two symmetrical clamping arms 31 integral with the base 3. The clamping arms 31 have a respective eyed end 32. When the clamping arms 31 are attached to a terminal 21 of a battery, a screw bolt 33 is installed to fasten the eyed ends 32 of the clamping arms 31 together, causing the clamping arms 31 to be secured to the terminal 21 firmly. This structure of battery connector has drawbacks. Because gaps exist between the terminal 21 and the clamping arms 31 after installation of the battery connector, battery power cannot be efficiently transmitted from the battery to the electrical cable 4 without causing a loss. Further, because the clamping arms 31 have a certain thickness, much effort shall be applied to the screw bolt 33 when rotating the screw bolt 33.

SUMMARY OF THE INVENTION

The present invention has been accomplished to provide a battery connector which eliminates the aforesaid drawbacks. According to the present invention, the battery connector comprises a conductive base having two receiving portions separated by a longitudinal split for receiving electrical cables in holes thereon and a smoothly arched mounting portion connected between the receiving portions at one end, and a screw bolt inserted through a transverse through hole on one receiving portion and threaded into a transverse screw hole on the other receiving portion to fasten up the two receiving portions, so as to secure the smoothly arched mounting portion to a terminal of a battery. Because the conductive base is firmly secured to the terminal of the battery and covered around the periphery of the terminal, electrical current can be efficiently transmitted from the terminal of the battery to the electrical cables without causing a loss.

DETAILED DESCRIPTION OF THE PREFERRED EMBODIMENT

Figure 1:
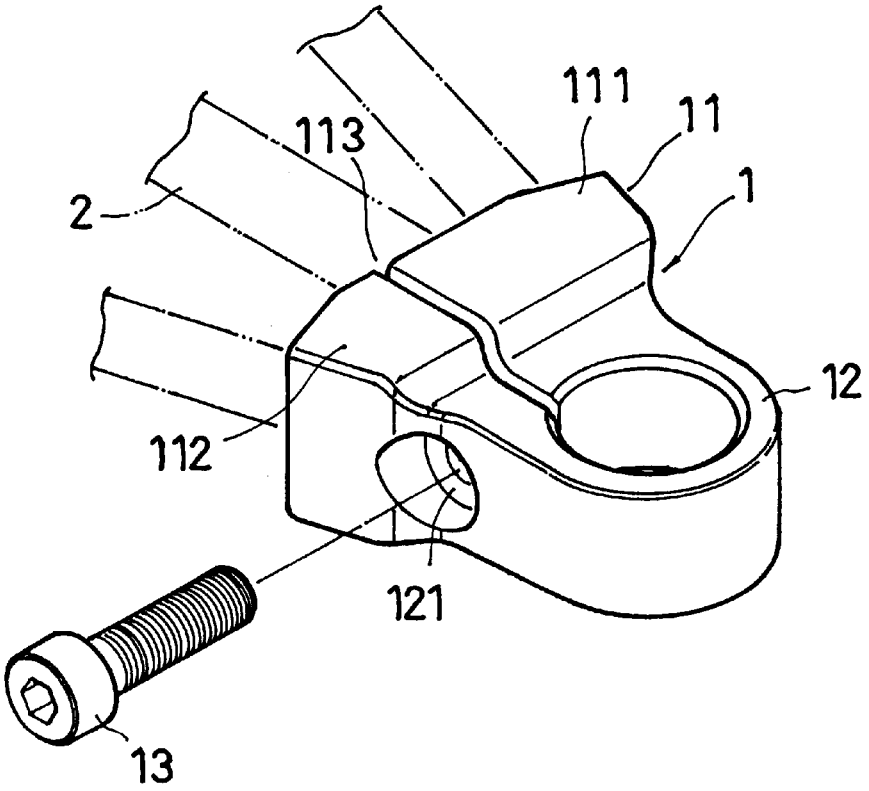
FIG. 1 is an exploded view of the present invention.
Figure 2:
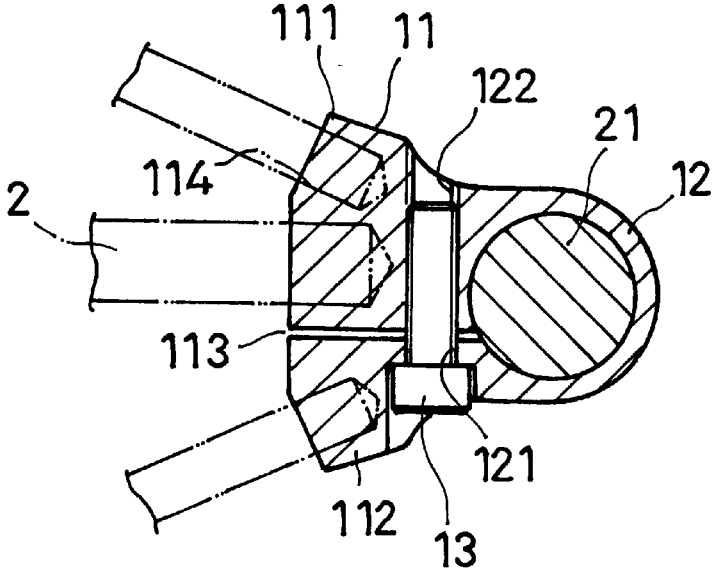
FIG. 2 is a sectional view showing the battery connector fastened to the battery terminal.

Referring to FIGS. 1 and 2, a battery connector 1 comprises a conductive base 11, and a screw bolt 13 for securing the conductive base 11 to a battery terminal 21. The conductive base 11 comprises a first receiving portion 111, a longitudinal split 113, a second receiving portion 112 separated from the first receiving portion 111 by the split 113, a smoothly arched mounting portion 12 connected between the first receiving portion 111 and the second receiving portion 112 at one end, a transverse screw hole 122 through the first receiving portion 111 in communication with the split 113, a transverse through hole 121 through the second receiving portion 112 in communication with the split 113 and in alignment with the transverse screw hole 122, and a plurality of cable mounting holes 114 at the receiving portions 111;112. When the smoothly arched mounting portion 12 is attached to the battery terminal 21, the screw bolt 13 is inserted through the transverse through hole 121 and threaded into the transverse screw hole 122 to fasten up the first receiving portion 111 and the second receiving portion 112, so as to secure the conductive base 1 firmly to the battery terminal 21. Further, electrical cables 2 can be fastened to the cable mounting holes 114 on the receiving portions 111;112 to transmit battery power supply to devices connected to opposite ends of the electrical cables 2.

Figure 3:
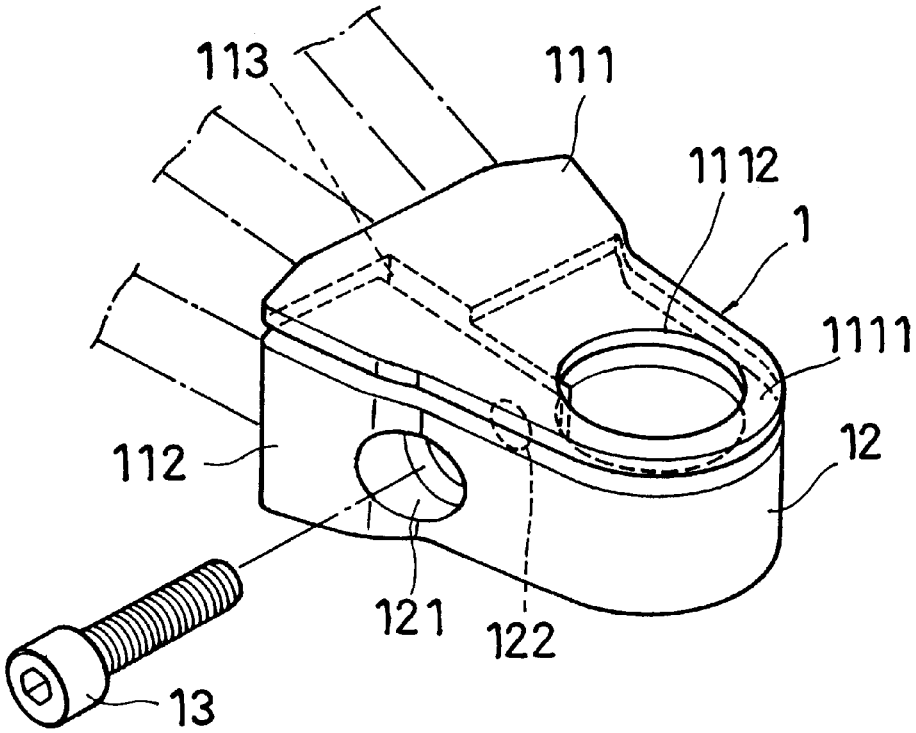
FIG. 3 is a perspective view of an alternate form of the battery connector according to the present invention.

FIG. 3 shows an alternate form of the battery connector 1. According to this alternate form, a metal plate 1111 is integral with the first receiving portion 111 at the top. The metal plate 111 extends over the split 113 and the second receiving portion 112 having a through hole 1112. When installed, the through hole 1112 receives the battery terminal.

Figure 4:
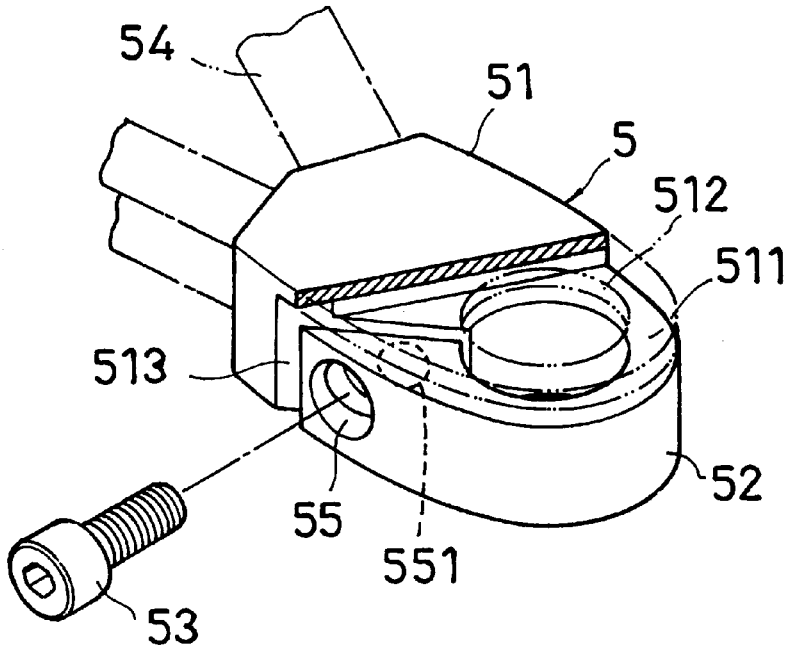
FIG. 4 is a perspective view of another alternate form of the battery connector according to the present invention.
Figure 5:
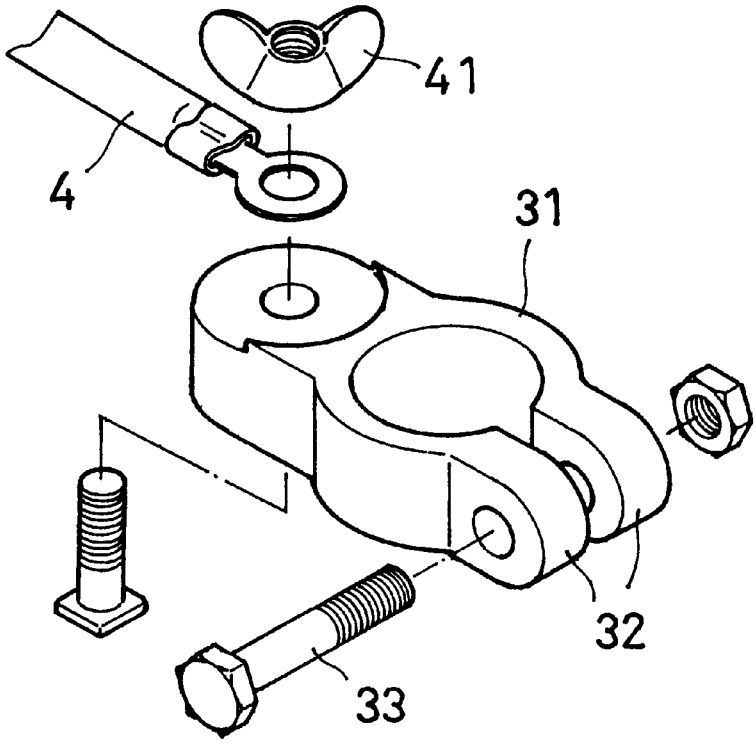
FIG. 5 PRIOR ART
FIG. 5 is an exploded view of a battery connector according to the prior art.
Figure 6:
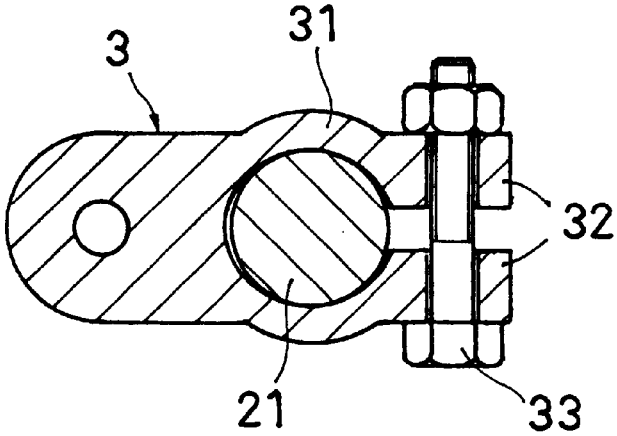
FIG. 6 PRIOR ART
FIG. 6 is a sectional view showing the battery connector of FIG. 5 installed.

FIG. 4 shows another alternate form of the battery connector according to the present invention. According to this alternate form, the conductive base 5 comprises an arched coupling portion 52 for mounting on the battery terminal, a receiving portion 51 extended from the arched coupling portion 52 for receiving electric cables 54, an oblique split 513 defined between the arched coupling portion 52 and the receiving portion 51, a transverse through hole 55 on the arched coupling portion 52, a screw hole 551 on the receiving portion 51, and a metal plate 511 integral with the receiving portion 51 at the top and extended over the oblique split 513 and the portion 52. The metal plate 511 has a through hole 512 for receiving the battery terminal. When a screw bolt 513 is screwed through the through hole 55 into the screw hole 551, the coupling portion 52 and the receiving portion 51 are closely attached together and firmly secured to the periphery of the battery terminal.

While only one embodiment of the present invention has been shown and described, it will be understood that various modifications and changes could be made thereunto without departing from the spirit and scope of the invention disclosed.

What the invention claimed is:

1. A battery connector comprising:

a conductive base, said conductive base comprising a first receiving portion, a longitudinal split, a second receiving portion separated from said first receiving portion by said longitudinal split, a smoothly arched mounting portion connected between said first receiving portion and said second receiving portion at one end, a transverse screw hole through said first receiving portion in communication with said longitudinal split, a transverse through hole through said second receiving portion in communication with said longitudinal split and in alignment with said transverse screw hole, and a plurality of cable mounting holes at said receiving portions for receiving electrical cables, said first receiving portion having a metal plate portion formed integrally in one piece formation therewith, said metal plate portion extending over said longitudinal split and said second receiving portion, said metal plate portion having a through hole formed therein for passing a terminal of a battery therethrough; and a screw bolt inserted through said transverse through hole on said second receiving portion and threaded into said transverse screw hole on said first receiving portion to fasten up said first receiving portion and said second receiving portion, so as to secure said smoothly arched mounting portion to the terminal of the battery.

2. A battery connector comprising:

a conductive base, said conductive base comprising an arched coupling portion for mounting on a terminal of a battery, a receiving portion extended from said arched coupling portion for receiving electric cables, an oblique split defined between said arched coupling portion and said receiving portion, a transverse through hole on said arched coupling portion, a screw hole on said receiving portion in alignment with said transverse through hole, and a metal plate portion formed integrally in one piece formation with said receiving portion at a top side thereof and extending over said oblique split and said arched coupling portion, said metal plate portion having a through hole formed therein for passing the terminal of the battery therethrough; and a screw bolt screwed through the transverse through hole on said arched coupling portion into the screw hole on said receiving portion to fasten up said coupling portion and said receiving portion, and to secure said coupling portion and said receiving portion to the terminal of the battery.

* * * * *